US009653850B1

(12) United States Patent
Su et al.

(10) Patent No.: US 9,653,850 B1
(45) Date of Patent: May 16, 2017

(54) ELECTRICAL CONNECTOR

(71) Applicant: Cheng Uei Precision Industry Co., Ltd., New Taipei (TW)

(72) Inventors: Yu-Hung Su, New Taipei (TW); Chin-Chou Wang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/083,277

(22) Filed: Mar. 28, 2016

(30) Foreign Application Priority Data

Dec. 11, 2015 (TW) ..... 104220016 U

(51) Int. Cl.

| | |
|---|---|
| ***H01R 13/648*** | (2006.01) |
| ***H01R 13/6585*** | (2011.01) |
| ***H01R 13/405*** | (2006.01) |
| ***H01R 24/60*** | (2011.01) |
| *H01R 107/00* | (2006.01) |

(52) U.S. Cl.
CPC ..... *H01R 13/6585* (2013.01); *H01R 13/405* (2013.01); *H01R 24/60* (2013.01); *H01R 2107/00* (2013.01)

(58) Field of Classification Search
CPC ..... H01R 13/6587; H01R 13/6594; H01R 23/6873; H01R 23/7073
USPC ..... 439/607.4, 607.09, 607.11
See application file for complete search history.

(56) References Cited

U.S. PATENT DOCUMENTS

2015/0244111 A1* 8/2015 Ju ..... H01R 13/6585 439/607.05

* cited by examiner

*Primary Examiner* — Phuong Dinh
(74) *Attorney, Agent, or Firm* — Cheng-Ju Chiang

(57) ABSTRACT

An electrical connector includes an insulating assembly, terminals, an inner shielding assembly and an outer shielding assembly. The insulating assembly has a tongue board at a front. The terminals are insert molded the insulating assembly and are divided into an upper row and a lower row with contacts portions located at a top side and a bottom side of the tongue board. Outmost two of the upper row of terminals and outmost two of the lower row of terminals are grounding terminals, outsides of rears of the contact portions of the grounding terminals form touch portions. The inner shielding assembly includes an upper shielding piece and a lower shielding piece located to a rear of the tongue board. The outer shielding assembly includes a shielding sleeve sleeving and spaced from the tongue board, the shielding sleeve contacts with at least one of the upper shielding piece and the lower shielding piece.

19 Claims, 13 Drawing Sheets

ELECTRICAL CONNECTOR

BACKGROUND OF THE INVENTION

1. Field of the Invention

The present invention generally relates to an electrical connector, and more particularly to an electrical connector capable of improving anti-abrasion performance.

2. The Related Art

A traditional electrical connector includes an insulating housing, a middle shielding plate, terminals and a shielding shell. The middle shielding plate is insert-molded in the insulating housing. The terminals are divided into two rows received in an upper side and a lower side of the insulating housing, respectively. The middle shielding plate is located between the two rows of terminals. Each of the terminals has a fixed portion, a contact portion extended frontward from a front end of the fixed portion and a solder portion extended from a rear end of the fixing portion. The shielding shell is mounted outside the insulating housing. An inserting space is formed between a front end of the shielding shell and a front end of the insulating housing.

However, the high frequency impedance of the terminals of the electrical connector can not meet a normal requirement in the test, and then the signal transmission of the electrical connector is unstable.

SUMMARY OF THE INVENTION

An object of the present invention is to provide an electrical connector capable of improving the high frequency performance thereof. The electrical connector includes an insulating assembly, terminals, an inner shielding assembly and an outer shielding assembly. The insulating assembly has a tongue board at a front thereof, a rear of a top side of the tongue board protrudes upward to form upper support bumps, a rear of a bottom side of the tongue board protrudes downward to form lower support bumps. The terminals are insert molded the insulating assembly and are divided into an upper row and a lower row. The terminals have contact portions located at the top side and the bottom side of the tongue board, fixed portions fixed in the insulating assembly and solder portions exposed from the insulating assembly, outmost two of the upper row of terminals and outmost two of the lower row of terminals are grounding terminals, outsides of rears of the contact portions of the grounding terminals form touch portions. The inner shielding assembly includes an upper shielding piece and a lower shielding piece, the upper shielding piece has an upper base plate and two upper side plates extending downward from two opposite sides of the upper base plate, the lower shielding piece has a lower base plate and two lower side plates extending upward from two opposite sides of the lower base plate. The upper base plate is located on the upper support bumps, and the upper side plates are located in two opposite sides of the tongue board. The lower base plate is located on the lower support bumps, the lower side plates is located in the two opposite sides of the tongue board and fixed with the corresponding the upper side plates. Each of the touch portions is located inside the corresponding upper side plate and the lower side plate and touching with at least one of the upper side plate and the lower side plate. The outer shielding assembly includes a shielding sleeve sleeving and spaced from the tongue board, the shielding sleeve contacts with at least one of the upper shielding piece and the lower shielding piece. Therefore, the electrical connector can have a better high frequency performance by cooperation of the grounding terminals, the upper shielding piece and the lower shielding piece and the outer shielding assembly.

Another object of the present invention is to provide an electrical connector an insulating assembly, terminals, a shielding piece and an outer shielding assembly. The insulating assembly has a tongue board at a front thereof. The terminals are insert-molded in the insulating assembly and divided into an upper row and a lower row. The terminals have contact portions located at the top side and the bottom side of the tongue board, fixed portions fixed in the insulating assembly and solder portions exposed from the insulating assembly. Outmost two of the upper row of the terminals and outmost two of the lower row of the terminals are grounding terminals, outsides of rears of the contact portions of the grounding terminals form touch portions. The shielding piece surrounds a rear end of the tongue board and is spaced from the top side and the bottom side of the tongue board and the rears of the contact portions of the terminals. Each of the touch portions touches with the shielding piece. The outer shielding assembly includes a shielding sleeve sleeving and spaced from the tongue board, the shielding sleeve contacts with the shielding piece. Therefore, the electrical connector can have a better high frequency performance by cooperation of the grounding terminals, the shielding piece and the outer shielding assembly.

A third object of the present invention is to provide an electrical connector which includes an upper dielectric body, a lower dielectric body engaging with the upper dielectric body, a separate tongue board, a middle shielding plate, and terminals. A front of the middle shielding plate is insert molded in the separate tongue board, a rear of the middle shielding plate is located between the upper dielectric body and the lower dielectric body to further locate the separate tongue board to a front end of the upper dielectric body and the lower dielectric body. The terminals are divided into an upper row and a lower row and have fixed portions, contact portions extended frontward from a front end of the fixed portions and solder portions. The fixed portions of the upper row of the terminals are insert-molded in the upper dielectric body. The fixed portions of the lower row of the terminals are insert-molded in the lower dielectric body. The rear of the middle shielding plate is located between the fixed portions of the upper row of the terminals and the fixed portions of the lower row of the terminals. The contact portions of the terminals are located at a top side and a bottom side of the separate tongue board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
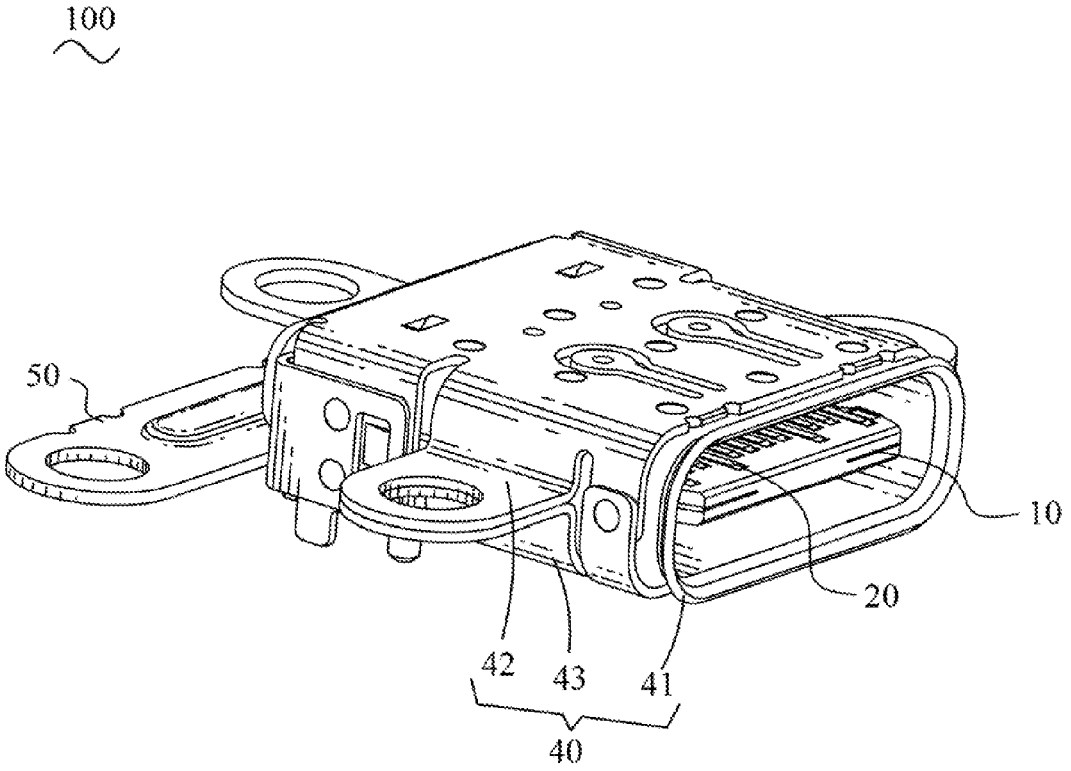
FIG. 1 is a perspective view of an electrical connector in accordance with an embodiment of the present invention.
Figure 2:
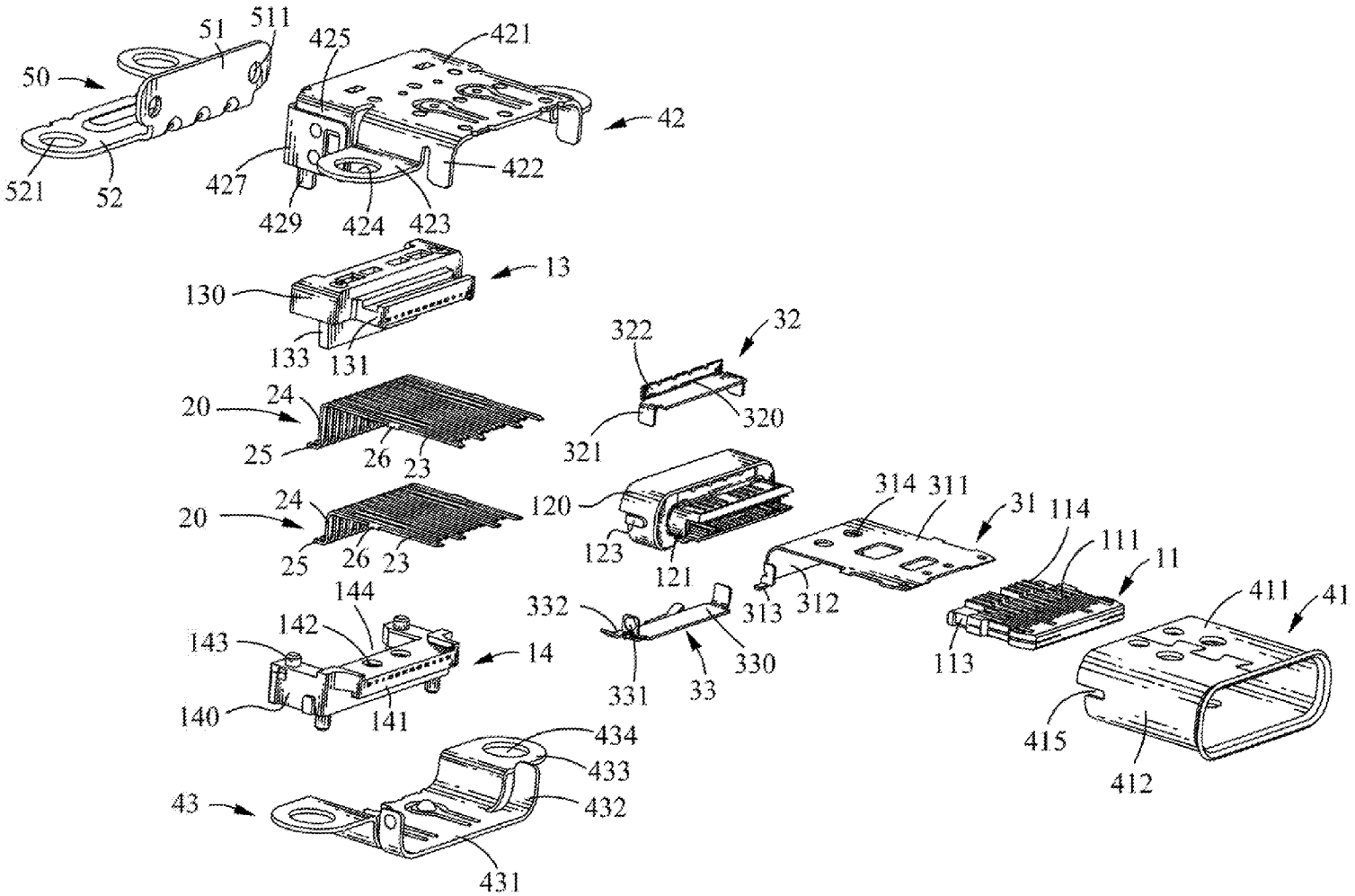
FIG. 2 is an exploded view of the electrical connector of FIG. 1.
Figure 3:
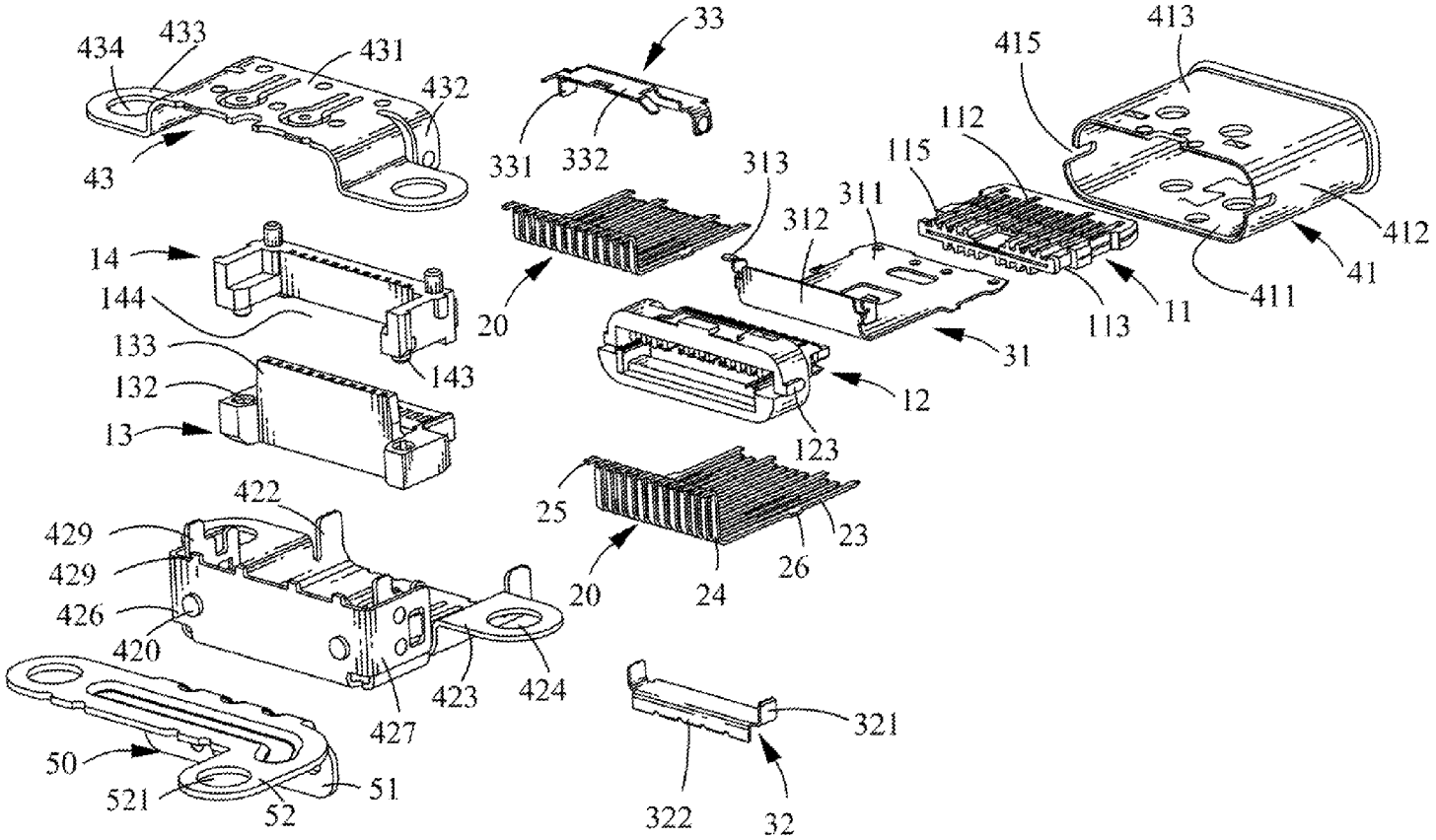
FIG. 3 is another exploded view of the electrical connector of FIG. 1.

With reference to FIGS. 1-3, an electrical connector 100 in accordance with an embodiment of the present invention is shown. The electrical connector 100 is mounted to a circuit board (not shown) and includes an insulating assembly 10, an inner shielding assembly 30, terminals 20, an outer shielding assembly 40 and a mounting frame 50.

Referring to FIG. 2 and FIG. 3, the insulating assembly 10 includes a separate tongue board 11, an insulating body 12, an upper dielectric body 13 and lower dielectric body 14.

The separate tongue board 11 defines a plurality of first terminal grooves 111 at a top surface thereof and a plurality of second terminal grooves 112 at a bottom surface thereof. A rear of each of two side surfaces of the separate tongue board 11 defines a fixing groove 113 penetrating a top and a bottom thereof. A rear portion of each of outmost two of the first terminal grooves 111 penetrates outward one of the two side surfaces of the separate tongue board 11 to communicate with the corresponding fixing groove 113. A rear portion of each of outmost two of the second terminal grooves 112 penetrates outward one of the two side surfaces of the separate tongue board 11 to communicate with the corresponding fixing groove 113. A rear of the top surface of the separate tongue board 11 forms upper support bumps 114. A rear of the bottom surface of the separate tongue board 11 forms lower support bumps 115.

The insulating body 12 includes a base portion 120 and a tongue portion 121 extended from a front surface of the base portion 120. Two side surfaces of the base portion 120 protrude outward to form two positioning blocks 123.

The upper dielectric body 13 has an upper base body 130. A lower portion of a middle of a front surface of the upper base body 130 protrudes frontward to form an upper tongue body 131. A portion of a bottom surface of the upper base body 130 protrudes downward to form a vertical positioning board 133 and defines two first positioning holes 132 adjacent two opposite sides of the positioning board 133. A bottom surface of the upper tongue body 131 has two first positioning pillars 134.

The lower dielectric body 14 has a lower base body 140. An upper portion of a middle of a front surface of the lower base body 140 protrudes frontward to form a lower tongue body 141. A top surface of the lower tongue body 141 defines two second positioning holes 142. Two sides of a rear of a top surface of the lower base body 140 form two second positioning pillars 143. A mounting gap 144 is formed in a rear of the lower base body 140 and penetrates the top surface and a bottom surface of the lower base body 140.

Figure 4:
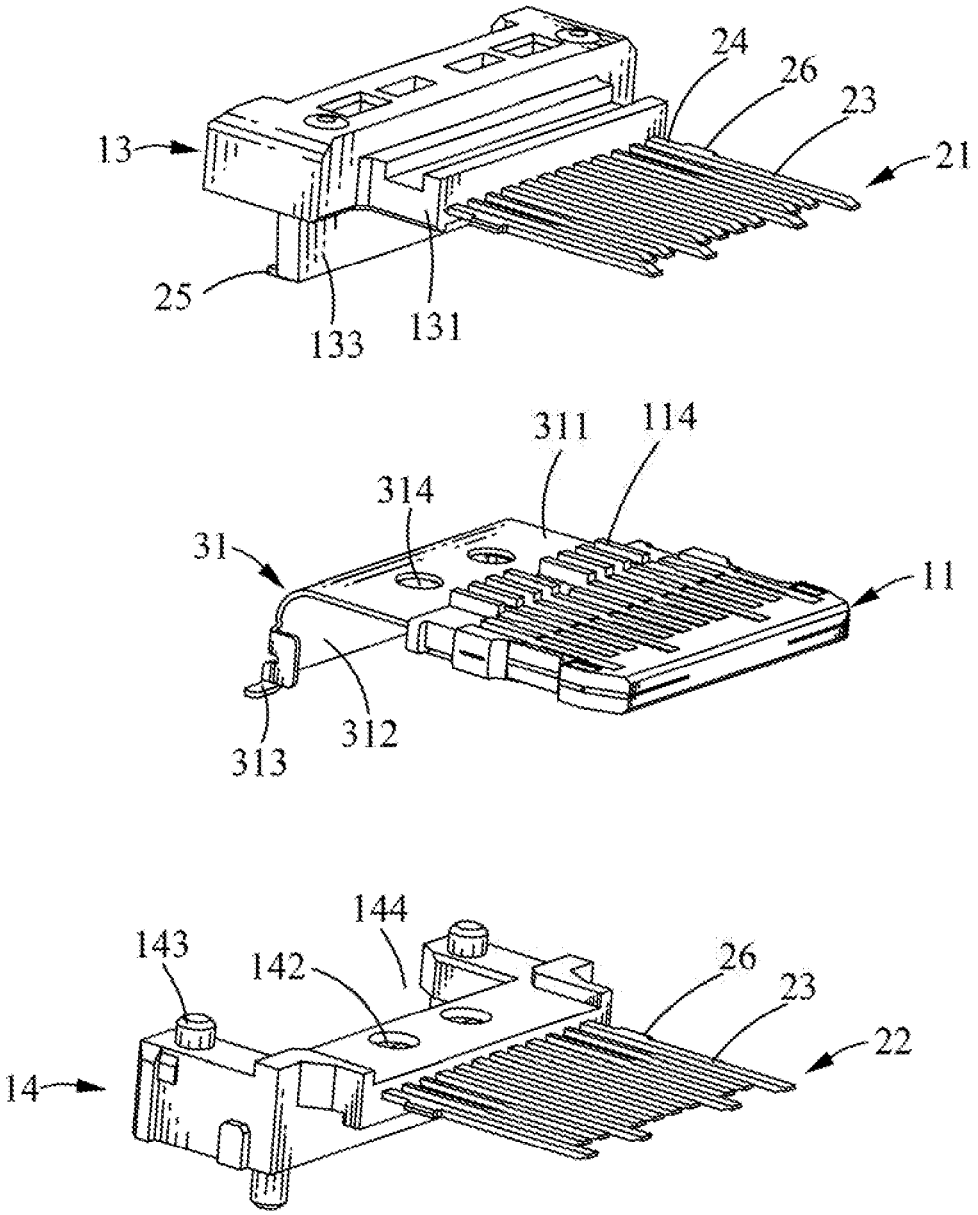
FIG. 4 is a perspective view showing an upper dielectric body with an upper row of terminals therein, a lower dielectric body with a lower row of terminals therein, and a middle shielding plate molded in a separate tongue board.
Figure 5:
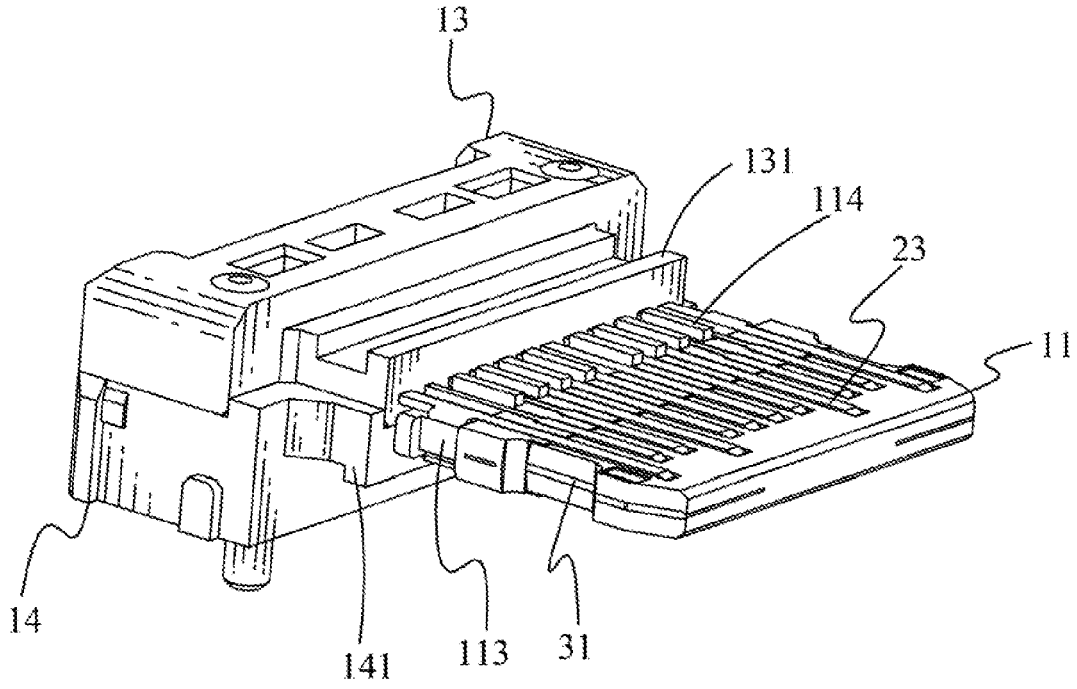
FIG. 5 is assembly view of FIG. 4.
Figure 6:
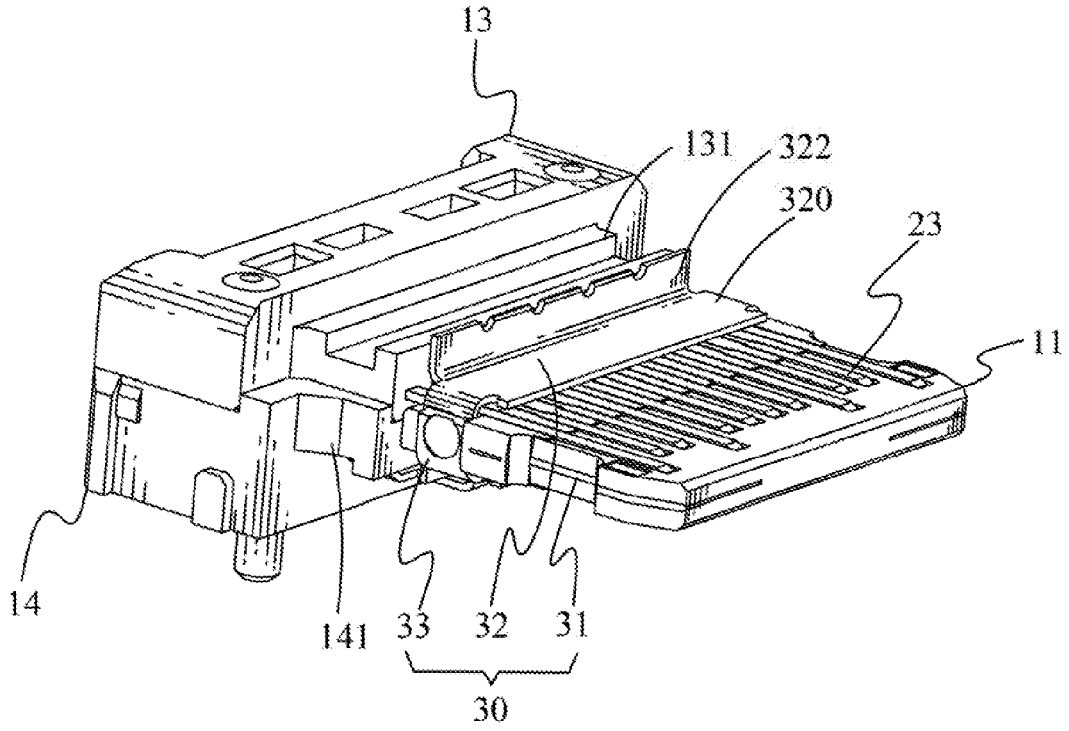
FIG. 6 is a perspective view showing an upper shielding piece and a lower shielding piece mounted to the assembly of FIG. 5.
Figure 7:
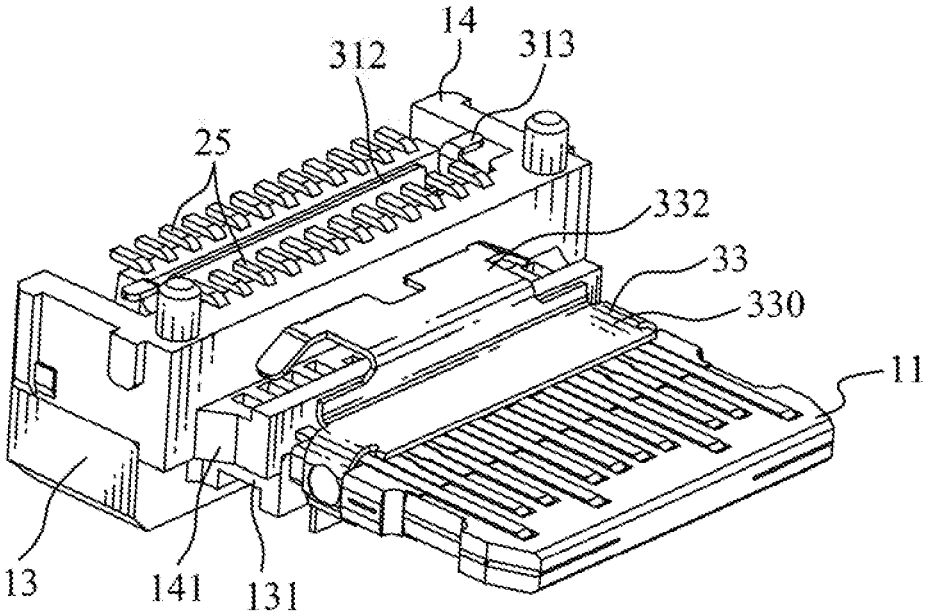
FIG. 7 is another perspective view of the assembly of FIG. 6.
Figure 8:
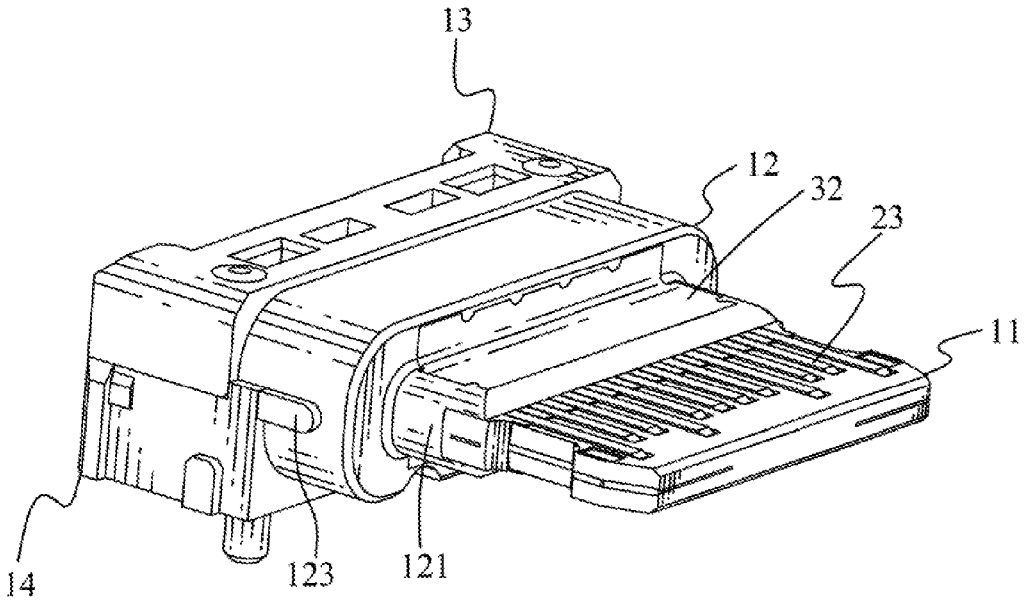
FIG. 8 is a perspective view showing an insulating body molded to the assembly of FIG. 6.
Figure 9:
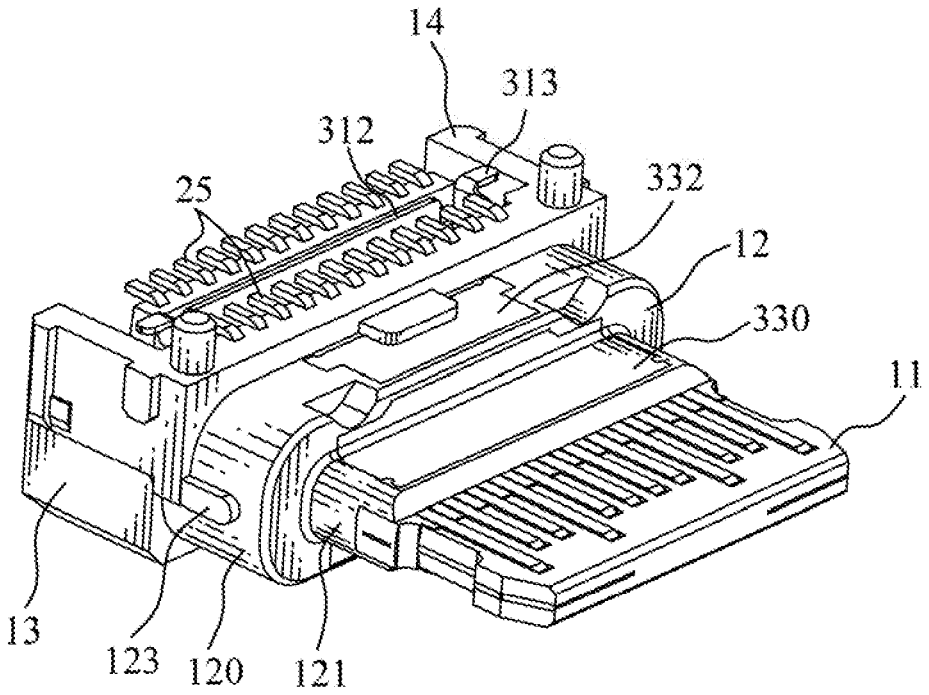
FIG. 9 is another perspective view of the assembly of FIG. 8.
Figure 10:
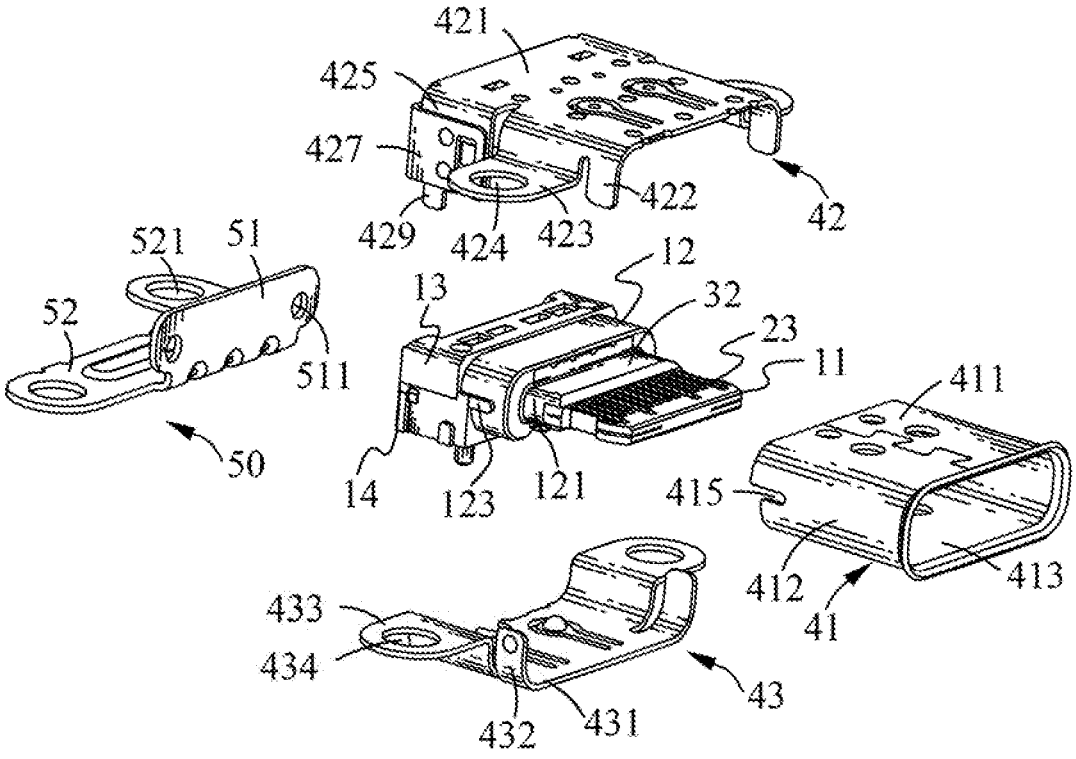
FIG. 10 to FIG. 12 are perspective views showing assembly processes of an outer shielding assembly of the electrical connector.
Figure 11:
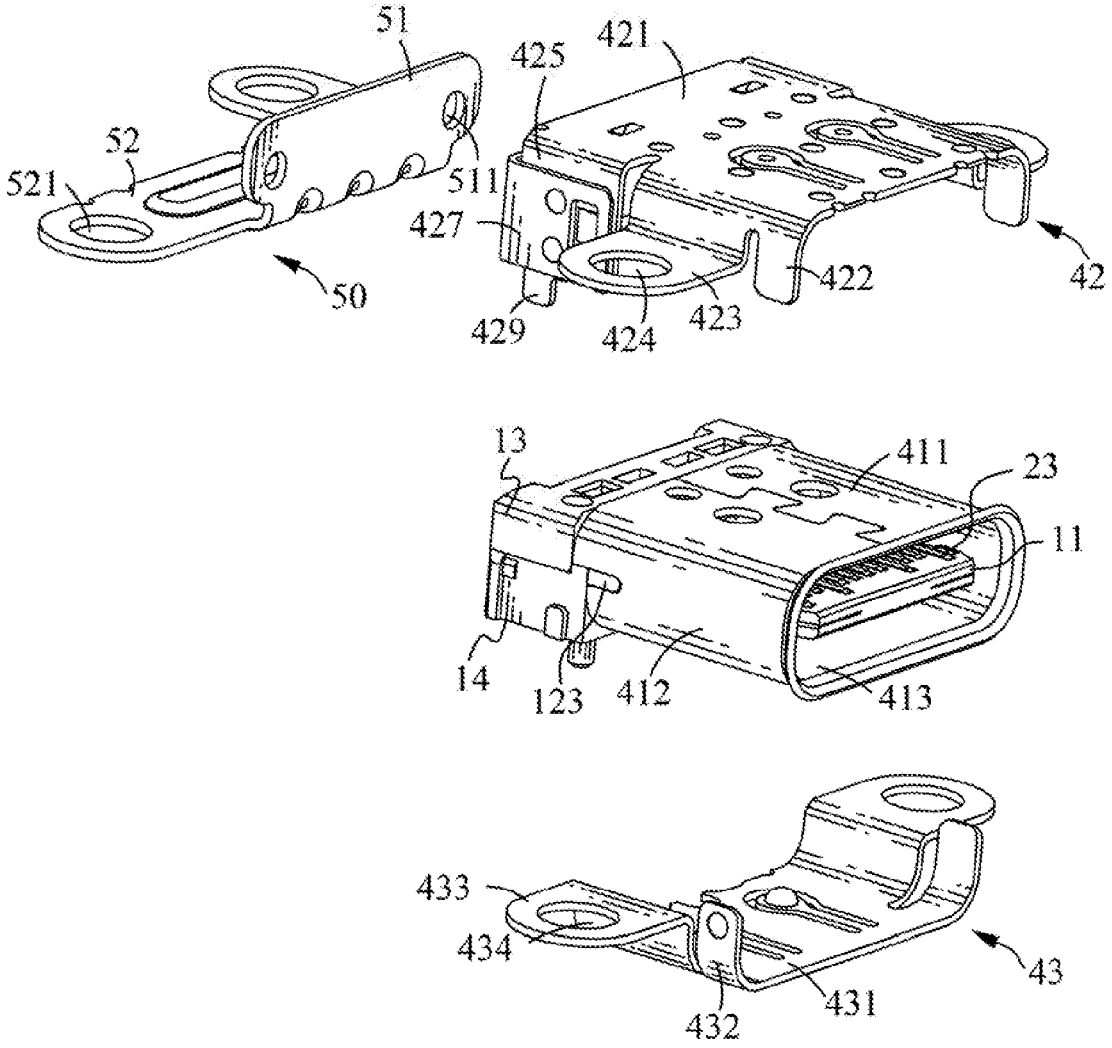
Figure 12:
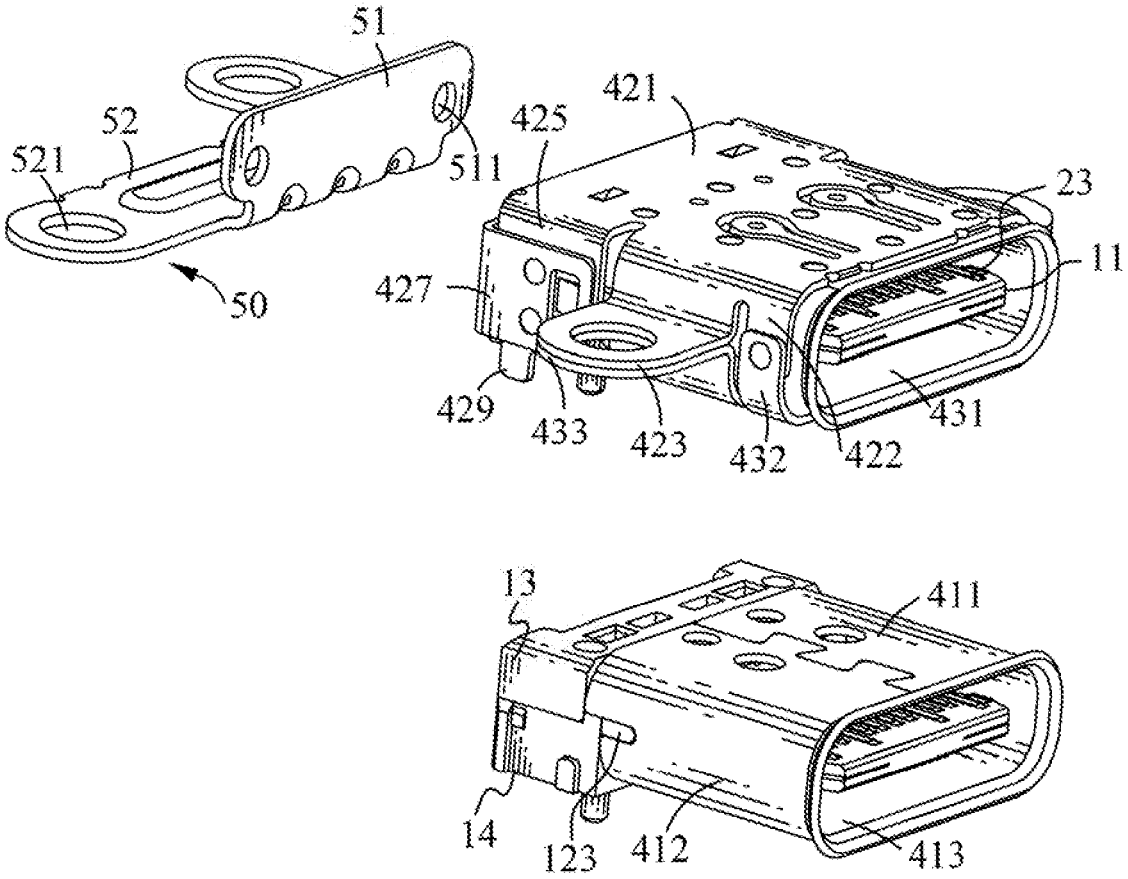
Figure 13:
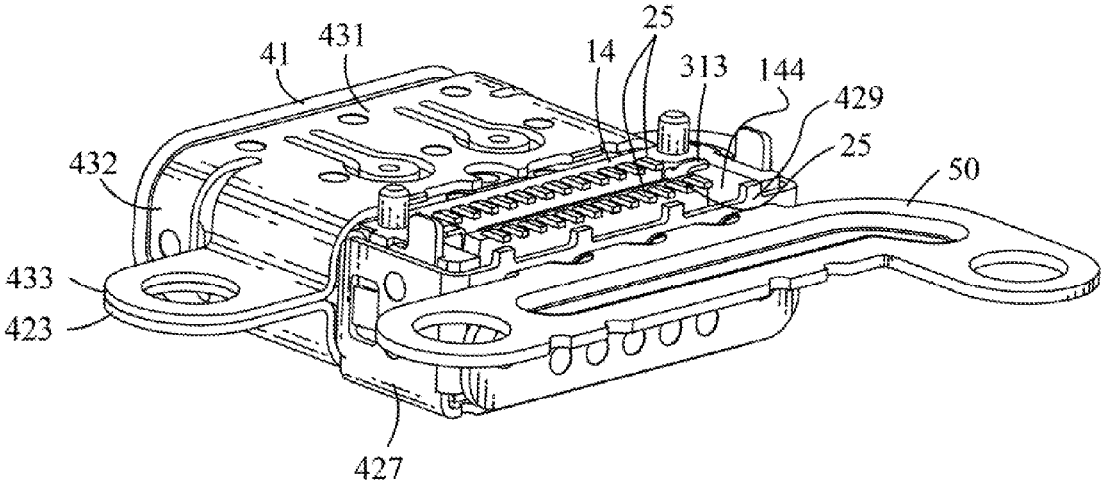
FIG. 13 is another perspective view of the electrical connector of FIG. 1.

Referring to FIGS. 2-4, the terminals 20 are divided into an upper row and lower row and include contact portions 23 extending frontward and rearward, fixed portions 24 extended rearward from rear ends of the contact portions 23 and then bent downward to show substantially inverted-L shape, and solder portions 25 extended rearward from lower ends of the fixed portions 24. The upper row of the terminals 21 are insert molded in the upper dielectric body 13, specifically, rears of the fixed portions 24 of the upper row of the terminals 21 are fixed in the upper base body 130 and the upper tongue body 131, vertical parts of the fixed portions 24 of the upper row of the terminals 20 are fixed in the positioning board 133, the contact portions 24 of the upper row of the terminals 21 extend out from a front surface of the upper tongue body 131, the solder portions 25 of the upper row of the terminals 21 extend out from a bottom of the positioning board 133. The lower row of the terminals 21 are insert molded in the lower dielectric body 14, specifically, the fixed portions 24 of the lower row of the terminals 21 are fixed in the lower base body 140 and the lower tongue body 141 and located in front of the mounting gap 144, the contact portions 24 of the lower row of the terminals 21 extend out from a front surface of the lower tongue body 141, the solder portions 25 of the lower row of the terminals 21 extend out from a bottom of the lower base body 140. Outmost two of the upper row of the terminals 21 and outmost two of the lower row of the terminals 21 are grounding terminals. Rears of the contact portions 24 of the grounding terminals protrude outward to form touch portions 26.

Referring FIGS. 2-4, the inner shielding assembly 30 includes a middle shielding plate 31, an upper shielding piece 32 and a lower shielding piece 33. The middle shielding plate 31 includes a level plate 311, a vertical plate 312 extending downward from a rear of the level plate 311, and a solder part 313 extending from a bottom of the vertical plate 312. A rear of the level plate 311 defines two third positioning holes 314. A front of the level plate 311 is insert-molded in the separate tongue board 11. The upper shielding piece 32 has an upper base plate 320, two upper side plates 321 extending downward from two opposite sides of the upper base plate 320, an upper rear piece 322 extending upward from a rear end of the upper base plate 320. The lower shielding piece 33 includes a lower base plate 330, two lower side plates 331 extending upward from two opposite sides of the lower base plate 331, and a lower rear piece 332 extending downward and rearward from a rear end of the lower base plate 330.

Referring FIG. 2, FIG. 3 and FIGS. 8-12, the outer shielding assembly 40 includes a shielding sleeve 41, an upper shielding shell 42 and a lower shielding shell 43. The shielding sleeve 41 includes a top plate 411, two first side plates 412 and a bottom plate 413. A middle of a rear edge of each of the first side plates 412 defines a positioning gap 415. The upper shielding shell 42 includes an upper shielding plate 421, front ends of two opposite side edges of the upper shielding plate 421 extend downward to form two upper fixing feet 422, middles of the two opposite side edges of the upper shielding plate 421 extend downward and then are bent outward to form two upper mounting plates 423. The two upper mounting plates 423 define two upper mounting holes 424. Rears of the two opposite side edges of the upper shielding plate 421 extend downward to form two second side plates 425. A rear edge of the upper shielding plate 421 extends downward to form a rear plate 426, two side edges of the rear plate 426 extends outward to form two strengthening plates 427, the strengthening plates 427 are fixed to outsides of the two second side plates 425 by wedge structure and laser beam welding. The upper shielding plate 421 is joined on the top plate 411 of the shielding sleeve 41 by laser beam welding. The second side plates 425 and the rear plate 426 of the upper shielding shell 41 protrude downward to form solder feet 429. The rear plate 426 protrudes rearward to form two locate pillars 420.

The lower shielding shell 43 includes a lower shielding plate 431, front ends of two opposite side edges of the lower shielding plate 431 extend upward to form two lower fixing feet 432, rear ends of two opposite side edges of the lower shielding plate 431 extend upward and then are bent outward to form two lower mounting plates 433 with two lower mounting holes 434 defined therein. The lower shielding plate 431 is fixed to a bottom plate 413 of the shielding sleeve 41 by laser beam welding. The lower fixing feet 432 are attached to outsides of the upper fixing feet 422 and are further fixed with the upper fixing feet 422 by laser beam welding. The upper mounting holes 424 align with the respective the lower mounting holes 434.

The mounting frame 50 includes a fastening plate 51 shown vertically, a bottom of the fastening plate 51 extends rearward to form an installing plate 52. The fastening plate 51 defines two locating holes 511. The installing plate 52 defines two installing holes 521 for fixing the electrical connector 100 in an electronic device (not shown). The mounting frame 50 is mounted to a rear surface of the rear plate 426 of the upper shielding shell 42, the locate pillars 420 of the upper shielding shell 42 are located in the locating holes 511, the fastening plate 51 is fixed with the rear plate 426 of the upper shielding shell 42 by laser beam welding.

Referring FIGS. 2-13, in assembly, a front of the level plate 311 of the middle shielding plate 31 is insert-molded in the separate tongue board 11. The upper row of the terminals 21 are insert molded in the upper dielectric body 13, the level parts of the fixed portions 24 of the upper row of the terminals 21 are fixed in the upper base body 130 and the upper tongue body 131, vertical parts of the fixed portions 24 of the upper row of the terminals 21 are fixed in the positioning board 133, the contact portions 23 of the upper row of the terminals 21 extend out from a front surface of the upper tongue body 131, the solder portions 25 of the upper row of the terminals 21 extends out from a bottom of the positioning board 133. The lower row of the terminals 21 are insert molded in the lower dielectric body 14, specifically, the fixed portions 24 of the lower row of the terminals 21 are fixed in the lower base body 140 and the lower tongue body 141 and located in front of the mounting gap 144, the contact portions 23 of the lower row of the terminals 21 extend out from a front surface of the lower tongue body 141, the solder portions 25 of the lower row of the terminals 21 extends out from a bottom of the lower base body 140.

The tongue board 11 together with the middle shielding plate 31, the upper dielectric body 13 together with the upper row of the terminals 21, and the lower dielectric body 14 with the low row of the terminals 22 are assembled together. The upper dielectric body 13 and the lower dielectric body 14 engage with each other. A rear of the middle shielding plate 31 is fixed between the upper dielectric body 13 and the lower dielectric body 14 to further make the separate tongue board 11 located in front of the upper dielectric body 13 and the lower dielectric body 14. The contact portions 23 of the upper row of the terminals 21 are received in the first terminal grooves 111 of the separate tongue board 11, the contact portions 23 of the lower row of the terminals 21 are received in the second terminal grooves 112 of the separate tongue board 11. Specifically, the vertical plate 312 of the middle shielding plate 31 is located in the mounting gap 144 of the lower dielectric body 14, the upper base body 130 and the lower base body 140 engage with each other, the upper tongue body 131 and the lower tongue body 141 engage with each other, the positioning board 133 is located in the mounting gap 144 and behind the vertical plate 312, the first positioning pillars 134 of the upper dielectric body 13 are positioned in the second positioning holes 142 of the lower dielectric body 14 and the third positioning holes 314 of the middle shielding plate 31, the second positioning pillars 143 of the upper dielectric body 14 are positioned in the first positioning holes 132 of the upper dielectric body 13, the contact portions 23 of the upper row of the terminals 21 extend out from the upper tongue body 131 to be located in the separate tongue board 11, the contact portions 23 of the lower row of the terminals 21 extend out from the lower tongue body 141 to be located in the separate tongue board 11.

Then, the upper shielding piece 32 and the lower shielding piece 33 are put on the separate tongue board 11. The upper base plate 320 of the upper shielding piece 32 is located on the upper support bumps 114, the upper side plates 321 are located in the fixing grooves 113, the upper rear piece 322 is located in front of a front surface of the upper tongue body 131. The lower base plate 330 of the lower shielding piece 33 is located on the lower support bumps 115, the lower side plates 331 are located in the fixing grooves 113 and are attached outside the upper side plates 321 and further fixed with the upper side plates 321 by laser beam welding. The lower rear piece 332 is located under the lower tongue body 141.

Then, the rear of the separate tongue board 11, the upper shielding piece 32, the lower shielding piece 33, the upper tongue body 131 and the lower tongue body 141 are insert molded in the insulating body 12. The upper tongue body 131, the lower tongue body 141, the upper rear piece 322 and the lower rear piece 332 are molded in the base portion 120 of the insulating body 12. The rear of the separate tongue board 11, the upper base plate 320 and the lower base plate 330 are insert molded in the tongue portion 121 with outer surfaces of the upper base plate 320 and the lower base plate 330 exposed outside. A front surface of the upper rear piece 322 is exposed from a front end of base portion 120. A bottom surface of the lower rear piece 332 is exposed from a bottom of the base portion 120. The upper side plates 321 and the lower side plates 331 are embedded in the tongue portion 121 of the insulating body 12.

The shielding sleeve 41 sleeves the insulating body 12, the separate tongue board 11 therein. The base portion 120 of the insulating body 12 is engaged into the shielding sleeve 41 with the positioning block 123 positioned in the positioning gap 415. The lower rear piece 332 of the lower shielding piece 33 contacts with an inner side of the bottom plate 413 of the shielding sleeve 41.

The upper shielding plate 421 is joined on the top plate 411 of the shielding sleeve 41 by laser beam welding. The upper fixing feet 422 and the second side plates 425 are located outside the first side plates 412. The rear plate 426 is located behind the upper base body 130 and the lower base body 140. The lower shielding plate 431 is joined on the bottom plate 413 of the shielding sleeve 41 by laser beam welding. The lower fixing feet 432 are attached outside the upper fixing feet 422 and fixed with the upper fixing feet 422 by laser beam welding. The upper mounting plates 423 engage with the lower mounting plates 433. The upper mounting holes 424 and the lower mounting hole 434 align with each other. The fastening plate 51 of mounting frame 50 is fixed to the rear plate 426 by laser beam welding, the locate pillars 420 are located in the locating holes 511.

As described above, the upper shielding piece 32 and the lower shielding piece 33 is disposed to a rear of the separate tongue board 11, an electrical connection is formed between the grounding terminals, the upper shielding piece 32, the lower shielding piece 33 and the shielding sleeve 41, therefore, a better high frequency performance of the electrical connector 100 can be realized.

What is claimed is:

1. An electrical connector, comprising:

an insulating assembly, the insulating assembly having a tongue board at a front thereof, a rear of a top side of the tongue board protruding upward to form upper support bumps, a rear of a bottom side of the tongue board protruding downward to form lower support bumps;

terminals, the terminals insert molded in the insulating assembly and divided into an upper row and a lower row, the terminals having contact portions located at the top side and the bottom side of the tongue board, fixed portions fixed in the insulating assembly and solder portions exposed from the insulating assembly, outmost two of the upper row of the terminals and outmost two of the lower row of the terminals being grounding terminals, outsides of rears of the contact portions of the grounding terminals forming touch portions;

an inner shielding assembly including an upper shielding piece and a lower shielding piece, the upper shielding piece having an upper base plate and two upper side plates extending downward from two opposite sides of the upper base plate, the lower shielding piece having a lower base plate and two lower side plates extending upward from two opposite sides of the lower base plate, the upper base plate being located on the upper support bumps, the upper side plates located in two opposite sides of the tongue board, the lower base plate being located on the lower support bumps, the lower side plates located in the two opposite sides of the tongue board and fixed with the corresponding upper side plates, each of the touch portions touching with at least one of the upper side plate and the lower side plate; and an outer shielding assembly, the outer shielding assembly including a shielding sleeve sleeving and spaced from the tongue board, the shielding sleeve contacting with at least one of the upper shielding piece and the lower shielding piece.

2. The electrical connector as claimed in claim 1, wherein the lower side plates are attached outside the corresponding upper side plates and further fixed with the corresponding upper side plates by laser beam welding.

3. The electrical connector as claimed in claim 2, wherein rears of the two opposite sides of the tongue board define two fixing grooves penetrating tops and bottoms thereof for receiving the upper side plates and the lower side plates therein.

4. The electrical connector as claimed in claim 1, wherein the insulating assembly further includes an insulating body, the rear of the tongue board, the upper shielding piece and the lower shielding piece are insert-molded in the insulating body.

5. The electrical connector as claimed in claim 1, wherein outer surfaces of the upper base plate and the lower base plate are exposed outside.

6. The electrical connector as claimed in claim 5, wherein the upper side plates and the lower side plates are embedded in the insulating body.

7. The electrical connector as claimed in claim 1, wherein the insulating assembly further includes an upper dielectric body and a lower dielectric body, the inner shielding assembly further includes a middle shielding plate, a front of the middle shielding plate is molded in the tongue board, the tongue board is separate, a rear of the middle shielding plate is fixed between the upper dielectric body and the lower dielectric body to further make the tongue board located in front of the upper dielectric body and the lower dielectric body, the fixed portions of the upper row of the terminals are insert molded in the upper dielectric body, the fixed portions of the lower row of the terminals are insert molded in the lower dielectric body.

8. The electrical connector as claimed in claim 7, wherein the upper dielectric body has an upper base body and an upper tongue body protruded frontward from a lower portion of a middle of a front surface of the upper base body, the lower dielectric body has a lower base body and a lower tongue body protruded frontward from an upper portion of a middle of a front surface of the lower base body, the upper base body and the lower base body engage with each other, the upper tongue body and the lower tongue body engage with each other, the contact portions of the upper row of the terminals extend out from the upper tongue body to be located in the tongue board, the contact portions of the lower row of the terminals extend out from the lower tongue body to be located in the tongue board.

9. The electrical connector as claimed in claim 8, wherein the insulating assembly further includes an insulating body, the insulating body has a base portion and a tongue portion extended from a front surface of the base portion, the upper tongue body and the lower tongue body are insert molded in the base portion, a periphery of the base portion is smaller than the assembly of the upper base body and the lower base body, the rear of the separate tongue board, the upper base plate and the lower base plate are insert molded in the tongue portion with outer surfaces of the upper base plate and the lower base plate exposed outside, the base portion of the insulating body is engaged into the shielding sleeve.

10. The electrical connector as claimed in claim 9, wherein the upper side plates and the lower side plates are embedded in the tongue portion of the insulating body.

11. The electrical connector as claimed in claim 9, wherein a rear end of the upper base plate extends upward to form an upper rear piece located in front of a front surface of the upper tongue body, a rear end of the lower base plate extends downward and then rearward to form a lower rear piece located under the lower tongue body, the upper rear piece and the lower rear piece are insert molded in the base portion, a front surface of the upper rear piece is exposed from a front end of the base portion, a bottom surface of the lower rear piece is exposed from a bottom of the base portion.

12. An electrical connector, comprising:

an insulating assembly, the insulating assembly having a tongue board at a front thereof;

terminals, the terminals insert molded in the insulating assembly and divided into an upper row and a lower row, the terminals having contact portions located at the top side and the bottom side of the tongue board, fixed portions fixed in the insulating assembly and solder portions exposed from the insulating assembly, outmost two of the upper row of the terminals and outmost two of the lower row of the terminals being grounding terminals, outsides of rears of the contact portions of the grounding terminals forming touch portions;

a shielding piece, the shielding piece surrounding a rear end of the tongue board and spaced from the top side and the bottom side of the tongue board and the rears of the contact portions of the terminals, each of the touch portions touching with the shielding piece; and an outer shielding assembly, the outer shielding assembly including a shielding sleeve sleeving and spaced from the tongue board, the shielding sleeve contacting with the shielding piece.

13. The electrical connector as claimed in claim 12, wherein the shielding piece includes an upper shielding piece and a lower shielding piece, the upper shielding piece has an upper base plate and two upper side plates extending downward from two opposite sides of the upper base plate, the lower shielding piece has a lower base plate and two lower side plates extending upward from two opposite sides of the lower base plate, the upper side plates are located in two opposite sides of the tongue board, the lower side plates are located in the two opposite sides of the tongue board and fixed with the corresponding upper side plates, each of the touch portions touches with at least one of the upper side plate and the lower side plate.

14. The electrical connector as claimed in claim 13, wherein the insulating assembly further includes an upper dielectric body and a lower dielectric body, the inner shielding assembly further includes a middle shielding plate, a front of the middle shielding plate is molded in the tongue board, the tongue board is separate, a rear of the middle shielding plate is fixed between the upper dielectric body and the lower dielectric body, the fixed portions of the upper row of the terminals are insert molded in the upper dielectric body, the fixed portions of the lower row of the terminals are insert molded in the lower dielectric body, the upper dielectric body has an upper base body and an upper tongue body, the lower dielectric body has a lower base body and a lower tongue body, the upper base body and the lower base body engage with each other, the upper tongue body and the lower tongue body engage with each other, the contact portions of the upper row of the terminals extend out from the upper tongue body to be located in the tongue board, the contact portions of the lower row of the terminals extend out from the lower tongue body to be located in the tongue board, the insulating assembly further includes an insulating body, the insulating body has a base portion and a tongue portion, the upper tongue body and the lower tongue body are insert molded in the base portion, a periphery of the base portion is smaller than the assembly of the upper base body and the lower base body, the rear of the separate tongue board, the upper base plate and the lower base plate are insert molded in the tongue portion, the base portion of the insulating body is engaged into the shielding sleeve.

15. An electrical connector, comprising:

an upper dielectric body;

a lower dielectric body engaging with the upper dielectric body;

a separate tongue board;

a middle shielding plate, a front of the middle shielding plate insert molded in the separate tongue board, a rear of the middle shielding plate located between the upper dielectric body and the lower dielectric body to further locate the separate tongue board to a front end of the upper dielectric body and the lower dielectric body; and terminals, the terminals being divided into an upper row and a lower row, the terminals having fixed portions, contact portions extended frontward from a front end of the fixed portions and solder portions, the fixed portions of the upper row of the terminals insert molded in the upper dielectric body, the fixed portions of the lower row of the terminals insert molded in the lower dielectric body, the rear of the middle shielding plate located between the fixed portions of the upper row of the terminals and the fixed portions of the lower row of the terminals, the contact portions of the terminals located at a top side and a bottom side of the separate tongue board;

wherein the upper dielectric body has an upper base body and an upper tongue body protruded frontward from a lower portion of a middle of a front surface of the upper base body, the lower dielectric body has a lower base body and a lower tongue body protruded frontward from an upper portion of a middle of a front surface of the lower base body, the upper base body and the lower base body engage with each other, the upper tongue body and the lower tongue body engage with each other, the contact portions of the upper row of the terminals extend out from the upper tongue body to be located in the separate tongue board, the contact portions of the lower row of the terminals extend out from the lower tongue body to be located in the separate tongue board.

16. The electrical connector as claimed in claim 15, further comprising an insulating body molded outside the upper tongue body, the lower tongue body and the rear of the separate tongue board.

17. The electrical connector as claimed in claim 16, wherein the insulating body has a base portion and a tongue portion extended from a front surface of the base portion, the base portion is molded outside the upper tongue body and the lower tongue body, a periphery of the base portion is smaller than the assembly of the upper base body and the lower base body, the tongue portion is molded outside the rear of the separate tongue board.

18. The electrical connector as claimed in claim 16, further comprising an upper shielding piece, a lower shielding piece and a shielding sleeve, a rear of a top side of the separate tongue board protruding upward to form upper support bumps, a rear of a bottom side of the separate tongue board protruding downward to form lower support bumps, the upper shielding piece and the lower shielding piece supported on the upper support bumps and the lower support bumps and insert molded in the insulating body, the base portion of the insulating body sleeved to the shielding sleeve, the lower shielding piece and the upper shielding piece forming an electrical connection with the shielding sleeve.

19. The electrical connector as claimed in claim 15, wherein a bottom of the upper dielectric body has a vertical positioning board, a rear of a lower dielectric body defines a mounting gap, the middle shielding plate has a level plate and a vertical plate extended downward from a rear end of the level plate, the fixed portions of the terminals show inverted-L shape, parts of the fixed portions of the upper row of the terminals are molded in the positioning board, the fixed portions of the lower row of the terminals are located in front of the mounting gap, the positioning board is located in the mounting gap, a front of the level plate is insert mold in the separate tongue board, a rear of the level plate is located between the upper dielectric body and the lower dielectric body, the vertical plate is located in the mounting gap and located in front of the positioning board.

* * * * *